US006604979B1

(12) United States Patent
Liu

(10) Patent No.: US 6,604,979 B1
(45) Date of Patent: Aug. 12, 2003

(54) BUILT-UP SPINNING TOP

(76) Inventor: Kuo-Ching Liu, 5FL., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 10/201,689

(22) Filed: Jul. 24, 2002

(51) Int. Cl.[7] ..... A63H 1/00; A63H 3/08
(52) U.S. Cl. ..... 446/256; 446/387
(58) Field of Search ..... 446/268, 256, 446/257, 387, 388, 97

(56) References Cited

U.S. PATENT DOCUMENTS 2,314,744 A * 3/1943 Warren ..... 446/387
3,564,758 A * 2/1971 Willis ..... 446/109
4,789,370 A * 12/1988 Ellefson ..... 446/113
5,911,328 A * 6/1999 Shampo ..... 211/40
6,149,487 A * 11/2000 Peng ..... 446/114
6,439,953 B1 * 8/2002 Liu ..... 446/387

* cited by examiner

*Primary Examiner*—Derrick H. Banks
*Assistant Examiner*—Faye Francis
(74) *Attorney, Agent, or Firm*—Rosenberg, Klein & Lee

(57) ABSTRACT

A built-up spinning top is formed from a plurality of flat pieces, which are detachably connected to a flat board before being used to build up the top. The built-up spinning top mainly includes an elongate central shaft formed from two axially intersected shaft members to have a cross-shaped cross section, and a set of differently shaped and sized disc members sequentially mounted on the central shaft in a predetermined manner. The built-up spinning top may be spun with fingers or with the help of an ejecting platform and a push member. In the latter case, the disc members include two gear members to mesh with a toothed edge of a sliding way on the ejecting platform, so that the spinning top is rotated along the sliding way to finally eject therefrom to spin on a plane.

7 Claims, 9 Drawing Sheets

BUILT-UP SPINNING TOP

FIELD OF THE INVENTION

The present invention relates to a built-up spinning top, and more particularly to a spinning top assembled from a plurality of flat pieces for a user to spin it either with fingers or with the help of an ejecting platform and a push member.

BACKGROUND OF THE INVENTION

Generally, a built-up toy includes a plurality of flat parts that are initially formed on a board structure by stamping and can be separated from the board structure one by one to assemble into a desired toy by engaging slits preformed thereon with one another.

Most currently commercially available built-up toys are designed to construct only stationary and monotonous animals, plants, articles, etc., such as dinosaurs, dolls, and furniture. These built-up toys provide only still models and are therefore less interesting and attractive for play.

It is therefore desirable to develop a built-up toy that provides interesting and dynamic effect.

SUMMARY OF THE INVENTION

A primary object of the present invention is to provide a spinning top built up from a plurality of flat pieces. The flat pieces before being used to assemble the spinning toy are detachably connected to a flat board. A player may rotate the assembled spinning top with fingers or with the help of an ejecting platform and a hand-operated push member.

To achieve the above and other objects, the built-up spinning top of the present invention includes a cross-shaped central shaft formed from two axially intersected shaft members, and at least a large and a small disc member sequentially mounted on the central shaft from top to bottom.

In another embodiment of the present invention, the spinning top further includes a median disc member above the large disc member, an upper gear member located between the median and the large disc members, a lower gear member located between the large and the small disc members. The upper gear member has a diameter smaller than those of the median and the large disc members, so that an annular receiving space is formed around the upper gear member between the median and the large disc members. The spinning top may be positioned on an ejecting platform with the receiving space engaging with a sliding way on the ejecting platform and the upper gear member meshing with a toothed edge of a sliding way. A player may engage a push member with an upper end of the spinning top to rotate the latter along the sliding way and finally eject the spinning top from the ejecting platform to spin it on a flat plane.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
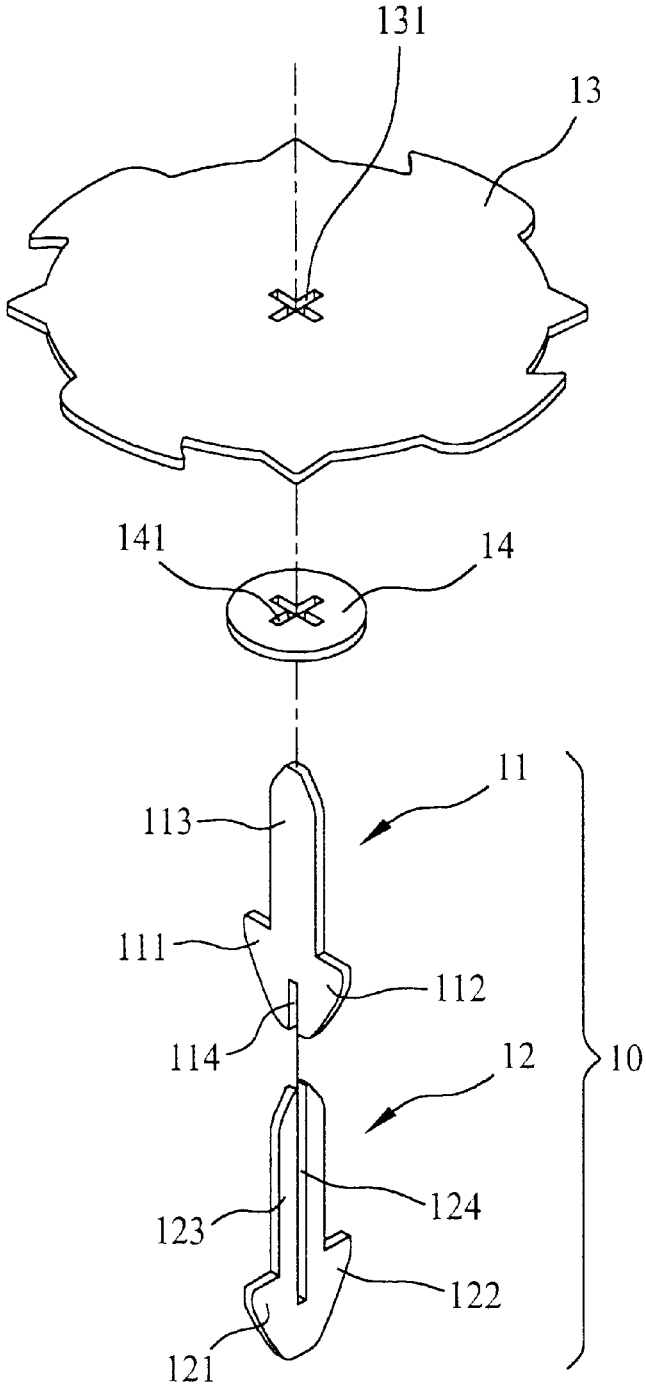
FIG. 1 is an exploded perspective view of a built-up spinning top according to a first embodiment of the present invention.
Figure 2:
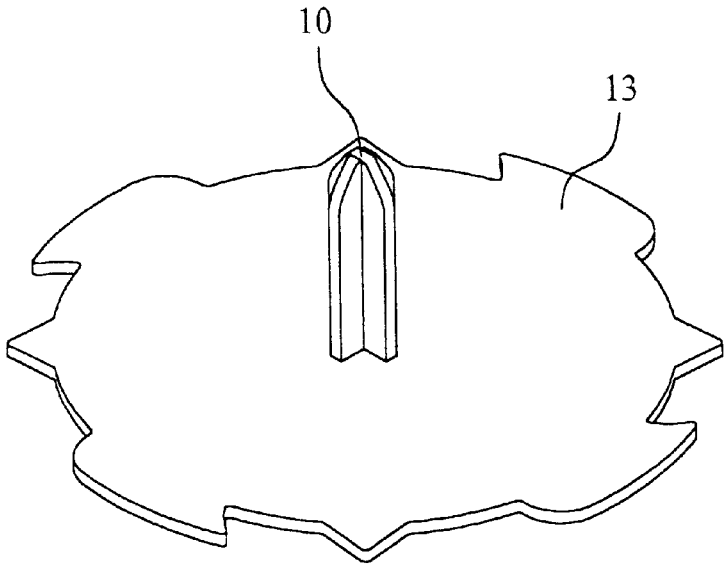
FIG. 2 is an assembled perspective view of the spinning top of FIG. 1.

Please refer to FIGS. 1 and 2 that are exploded and assembled perspective views, respectively, of a built-up spinning top according to a first embodiment of the present invention. As shown, the built-up spinning top of this embodiment includes an elongate central shaft 10 and at least a large and a small disc member 13, 14 sequentially mounted on the central shaft 10 from top to bottom.

The central shaft 10 is formed from axially intersected first and second shaft members 11, 12 and has a cross-shaped cross section. The first shaft member 11 is a flat piece including a long shaft body 113 and two stoppers 111, 112 extended from two lateral edges of the shaft body 113. A first slit 114 is upward extended from a lower end of the shaft body 113 by a predetermined distance. The second shaft member 12 is also a flat piece including a long shaft body 123 and two stoppers 121, 122 extended from two lateral edges of the shaft body 123. A second slit 124 is downward extended from an upper end of the shaft body 123 by a predetermined distance. By engaging the first and the second slit 114, 124 with each other, the first and the second shaft member 11, 12, and accordingly the long shaft bodies 113 and 123, are intersected and connected to each other to form the cross-shaped central shaft 10. The stoppers 111 and 112 and the stoppers 121 and 122 all have downward tapered outer edges to form two arrow-shaped lower portions that intersect with each other when the two shaft members 11, 12 are connected to each other. A pointed lower center of the intersected arrow-shaped lower portions serves as a spinning center of the built-up spinning top of the present invention. The perpendicularly intersected long shaft bodies 113, 123 maintain in an upward extended position.

Figure 3:
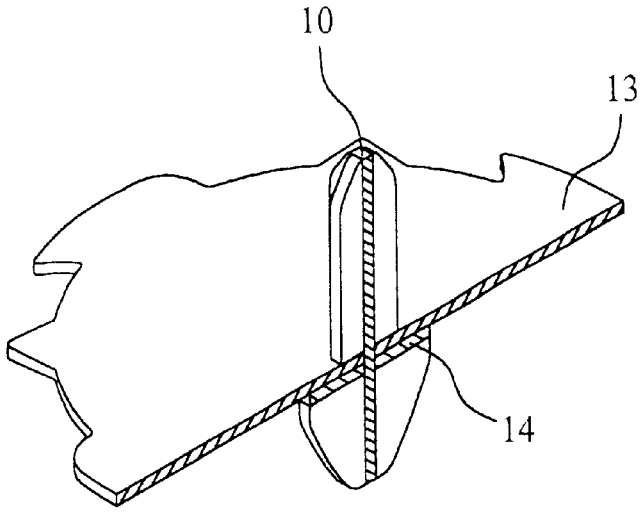
FIG. 3 is a sectioned perspective view of the spinning top of FIG. 1.

The large and the small disc member 13, 14 are sequentially located around the intersected long shaft bodies 113, 123 above the stoppers 111, 112, 121, and 122. In the illustrated first embodiment, the large disc member 13 at the uppermost position has a centered cross-shaped opening 131 for the central shaft 10 to extend therethrough. The small disc member 14 is located below the large disc member 13 and also has a centered cross-shaped opening 141. All the cross-shaped openings 131, 141 on the disc members 13, 14 are dimensioned for the central shaft 10 to tightly fit therein after being extended therethrough. As can be seen from FIGS. 2 and 3, this design prevents the disc members 13, 14 assembled to the central shaft 10 from downward passing the stoppers to easily separate from the central shaft 10.

Figure 4:
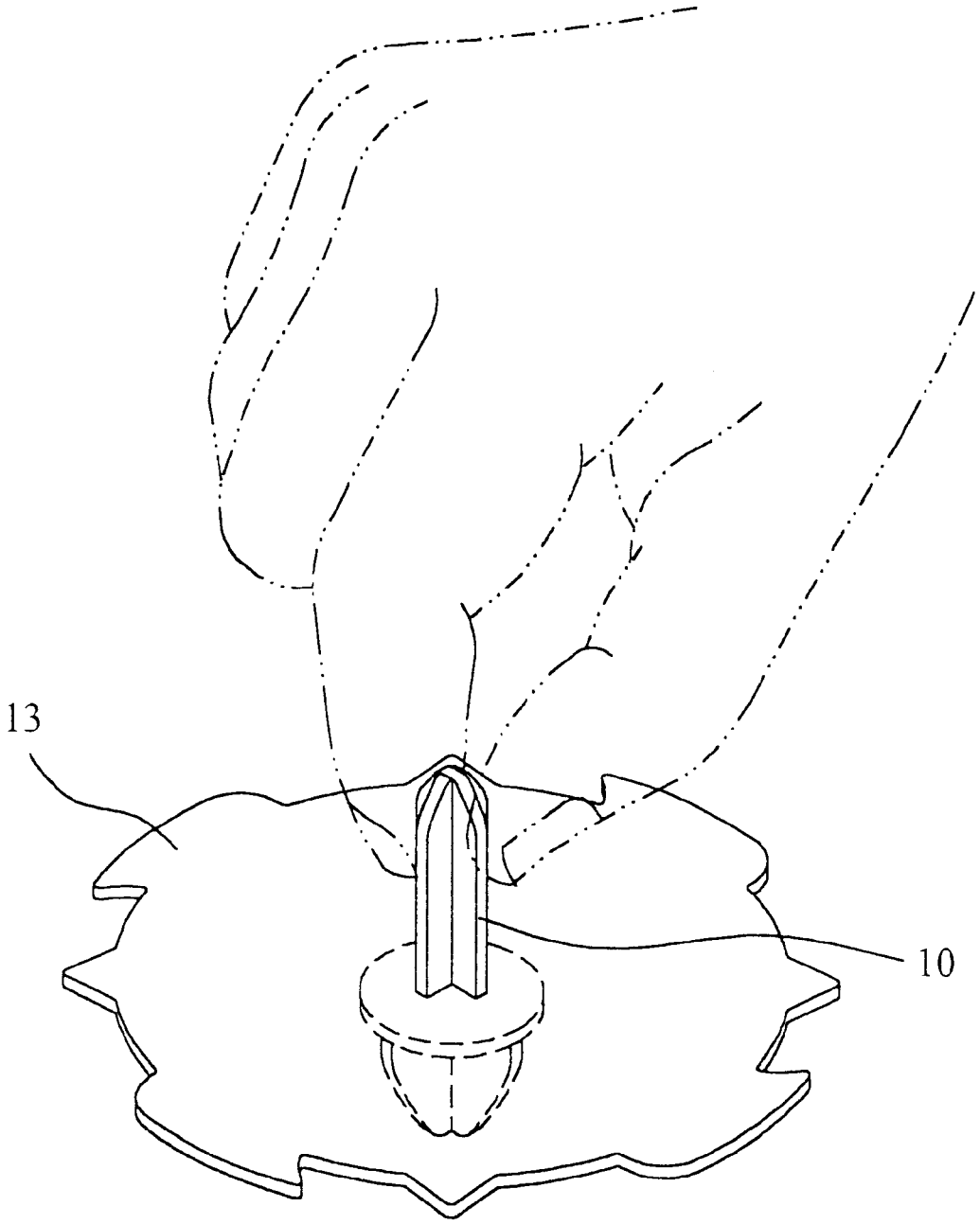
FIG. 4 shows the manner of turning the spinning top of FIG. 2 with fingers.

To play the built-up spinning top of FIG. 2, a user needs only to pinch and twist with fingers a portion of the central shaft 10 upward projected from the large disc member 13, as shown in FIG. 4. The twisted top would stand upright and spin about the pointed lower center of the intersected arrow-shaped portions formed from the stoppers 111, 112, 121, and 122 of the central shaft 10 to create interesting and dynamic effect.

Figure 11:
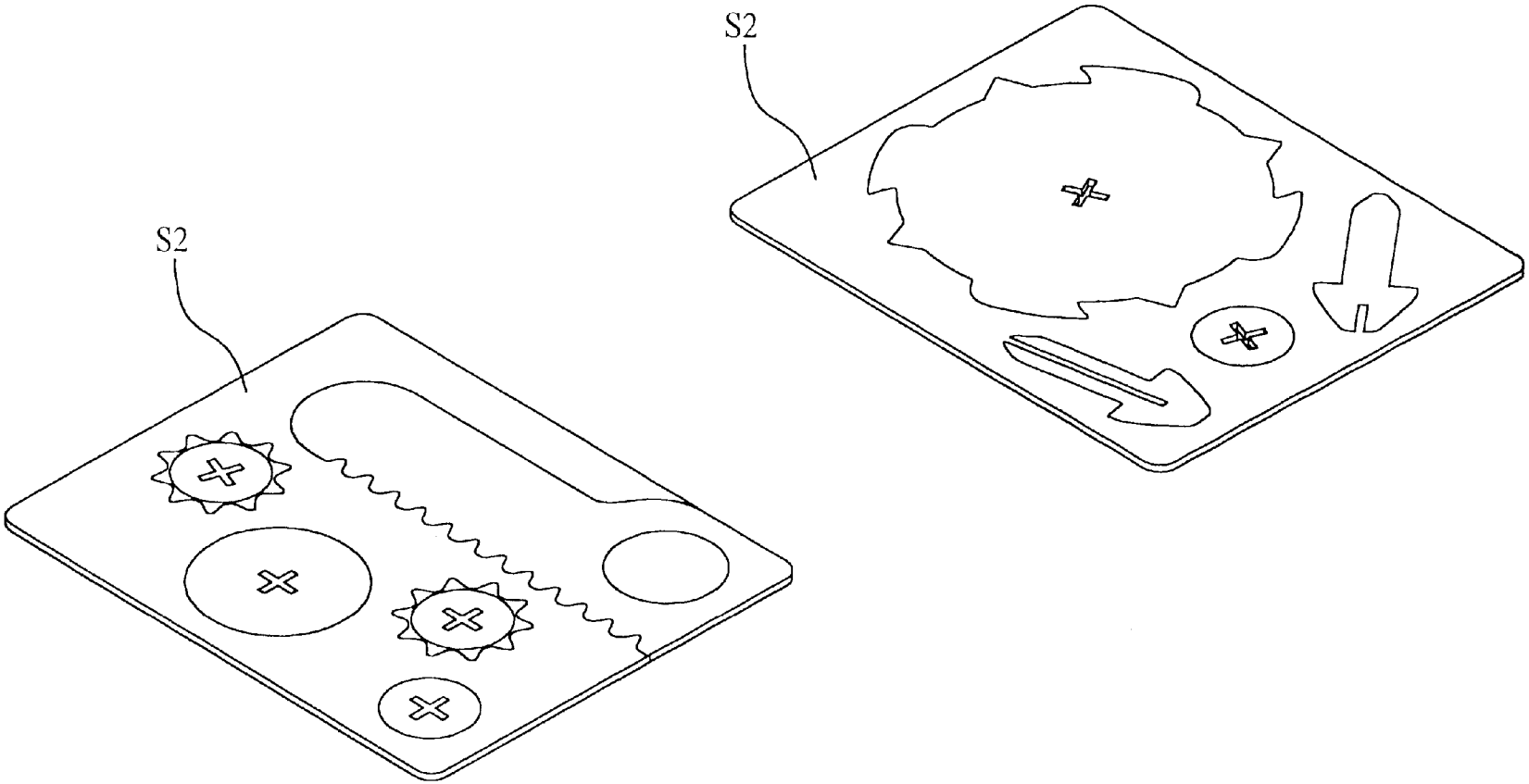
FIG. 11 shows all flat pieces for forming the built-up spinning top, the ejecting platform, and the hand-operated push member of the present invention are detachably connected to a flat board before they are used to form the present invention.

As can be seen from FIG. 11, all the flat pieces forming the built-up spinning top of the first embodiment of the present invention may be detachably connected to a flat-board S1 before they are used to form the spinning top.

In a built-up spinning top according to a second embodiment of the present invention, gear members, a median disc member, an ejecting platform, and a hand-operated push member are included to make the spinning top more interesting for play.

Figure 5:
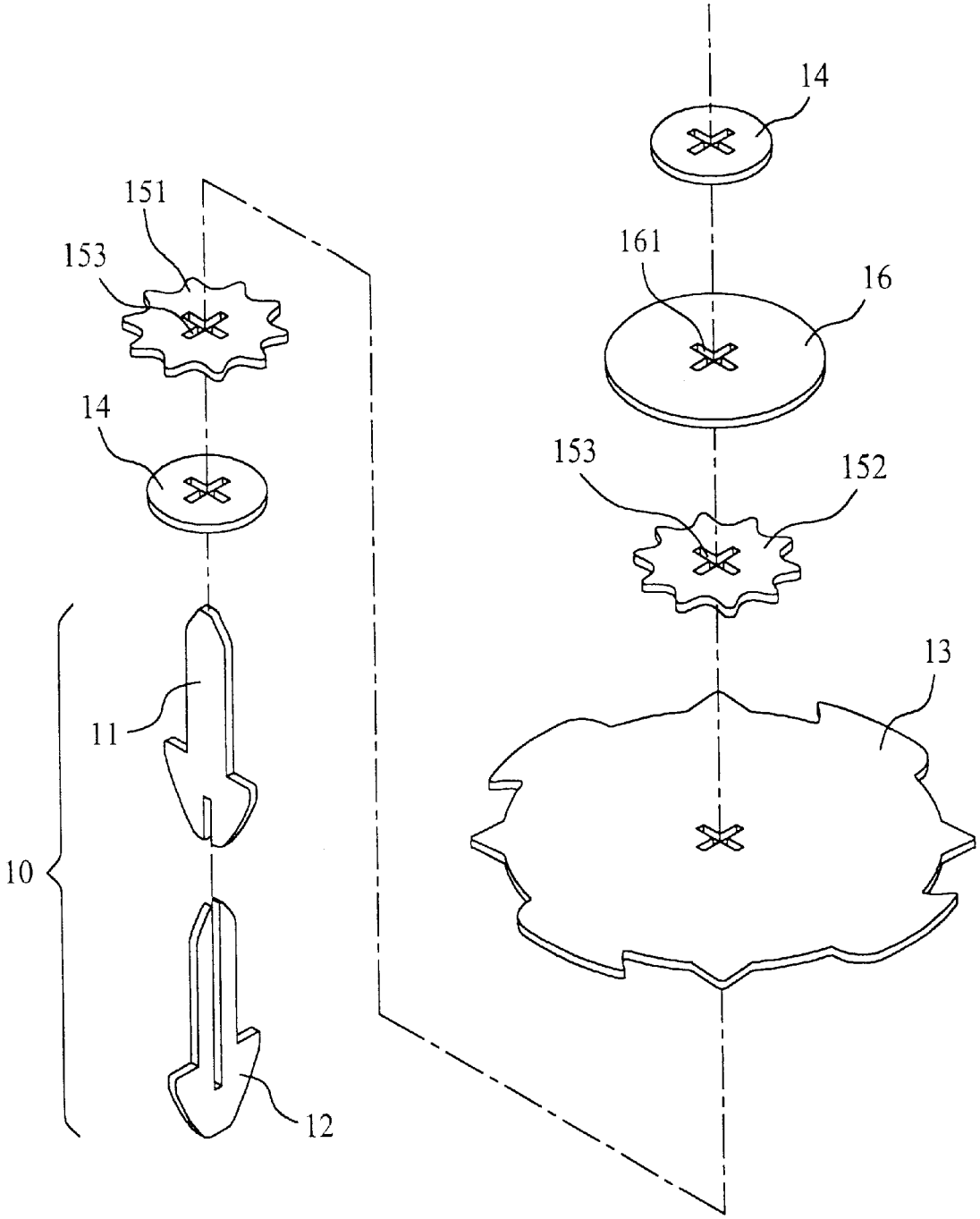
FIG. 5 is an exploded perspective view of a built-up spinning top according to another embodiment of the present invention.
Figure 6:
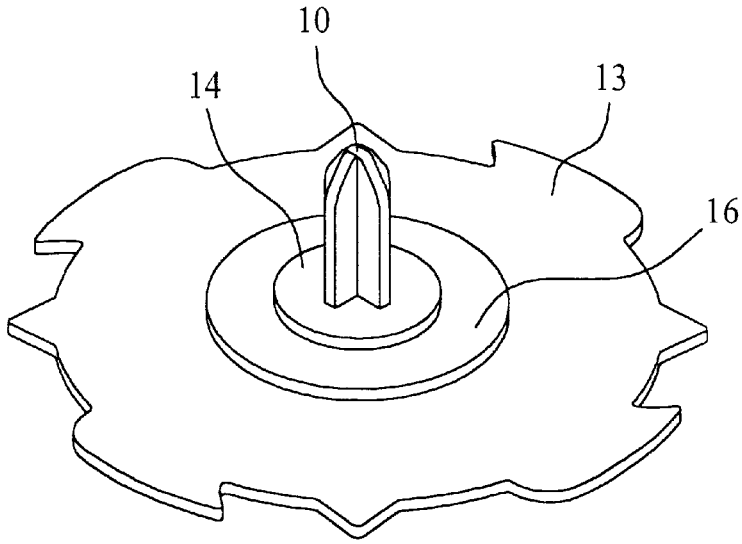
FIG. 6 is an assembled perspective view of the spinning top of FIG. 5.

FIGS. 5 and 6 are exploded and assembled perspective views, respectively, of the built-up spinning top according to the second embodiment of the present invention. As shown, in addition to a cross-shaped central shaft 10, a large disc member 13, and a first small disc member 14 which are the same as those for forming the first embodiment of the present invention, the spinning top of the second embodiment further includes a second small disc member 14, a median disc member 16, and a lower gear member 151 and an upper gear member 152 respectively located below and above the large disc member 13. All the members 14, 151, 152, and 16 are provided with a centered cross-shaped opening 141, 153, and 161 identical to the centered cross-shaped opening 141, 131 provided on the first small disc member 14 and the large disc member 13 for the central shaft 10 to extend therethrough. The lower gear member 151 is located between the large disc member 13 and the first small disc member 14, the upper gear member 152 is located between the large disc member 13 and the median disc member 16, and the second small disc member 14 is located above the median disc member 16. The median disc member 16 has a diameter larger than that of the gear members 151, 152 and serves as an upper holding-down member.

Figure 7:
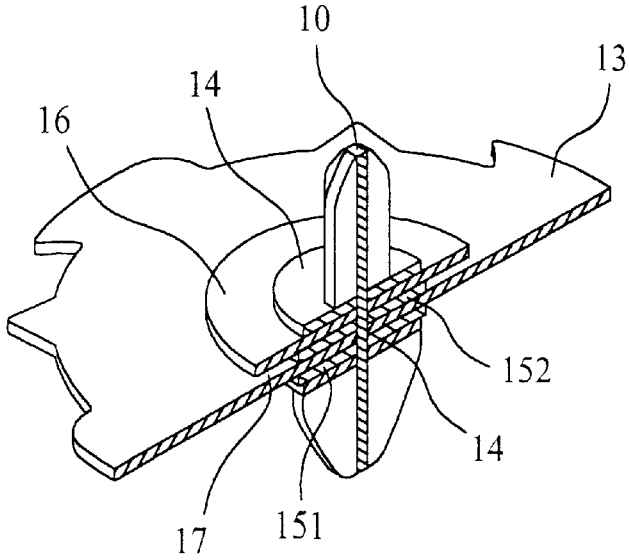
FIG. 7 is a sectioned perspective view of the spinning top of FIG. 5.

Please refer to FIG. 7 that is a sectioned perspective view of the built-up spinning top according to the second embodiment of the present invention. The upper gear member 152 located between the large and the median disc member 13, 16 has a diameter smaller than those of the large and the median disc members 13, 16. Therefore, an annular receiving space 17 is formed around the upper gear member 152 between the large and the median disc member 13, 16.

Figure 8:
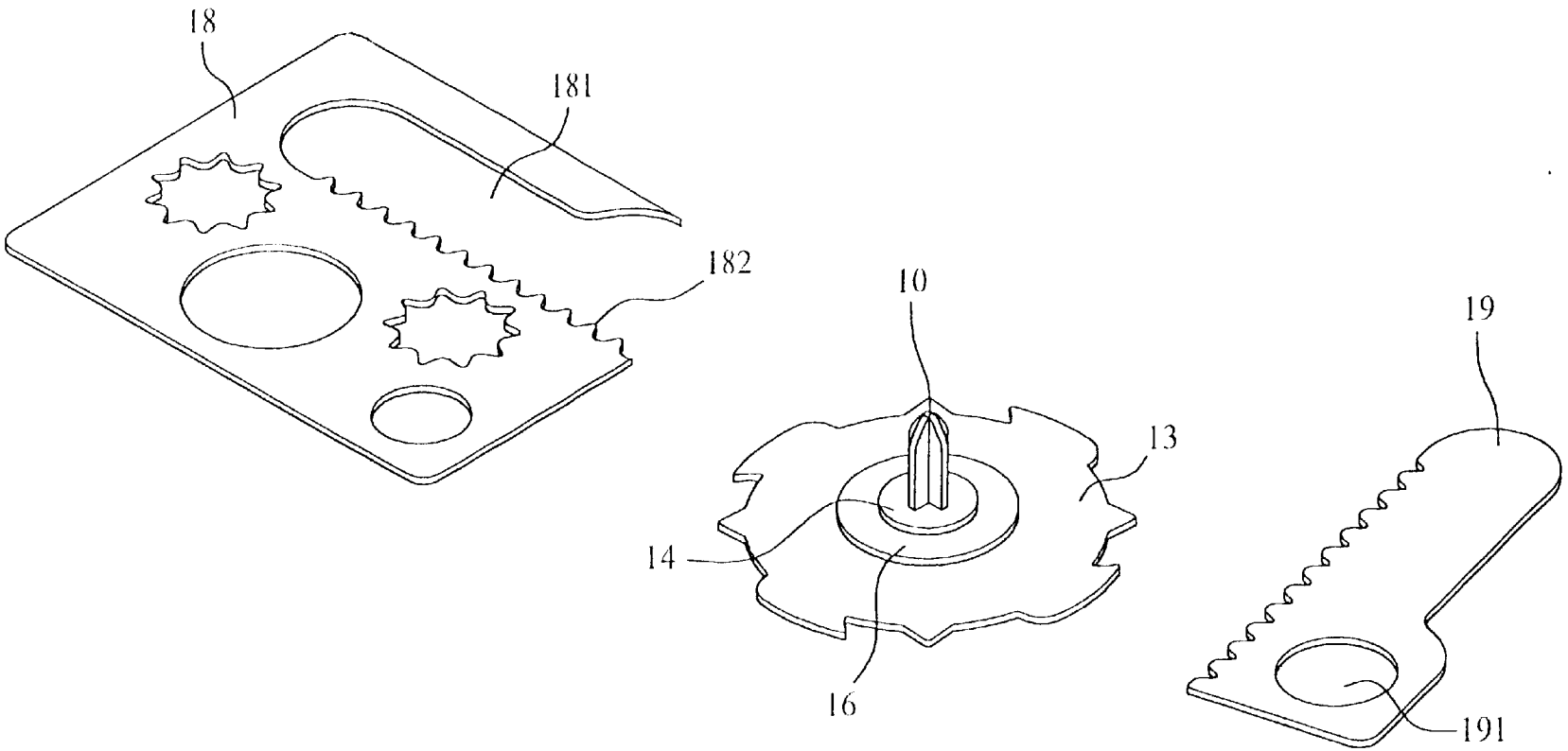
FIG. 8 shows an ejecting platform and a hand-operated push member that work together to eject and turn the built-up spinning top of FIG. 5.

To play the built-up spinning top of the second embodiment that includes gear members, a flat ejecting platform 18 and a flat hand-operated push member 19 are provided. Please refer to FIG. 8. The ejecting platform 18 defines a sliding way 181 having a toothed longitudinal edge 182. The sliding way 181 is so dimensioned in its width that the assembled spinning top of the second embodiment maybe slid into the sliding way 181 with the lower or the upper gear member 151 or 152 meshing with the toothed longitudinal edge 182 of the sliding way 181. A front end of the sliding way 181 is formed into an expanded opening to facilitate ejection of the spinning top from the ejecting platform 18. The hand-operated push member 19 is provided at a front end with a round hole 191, which has a diameter larger fan that of the small disc member 14.

Figure 9:
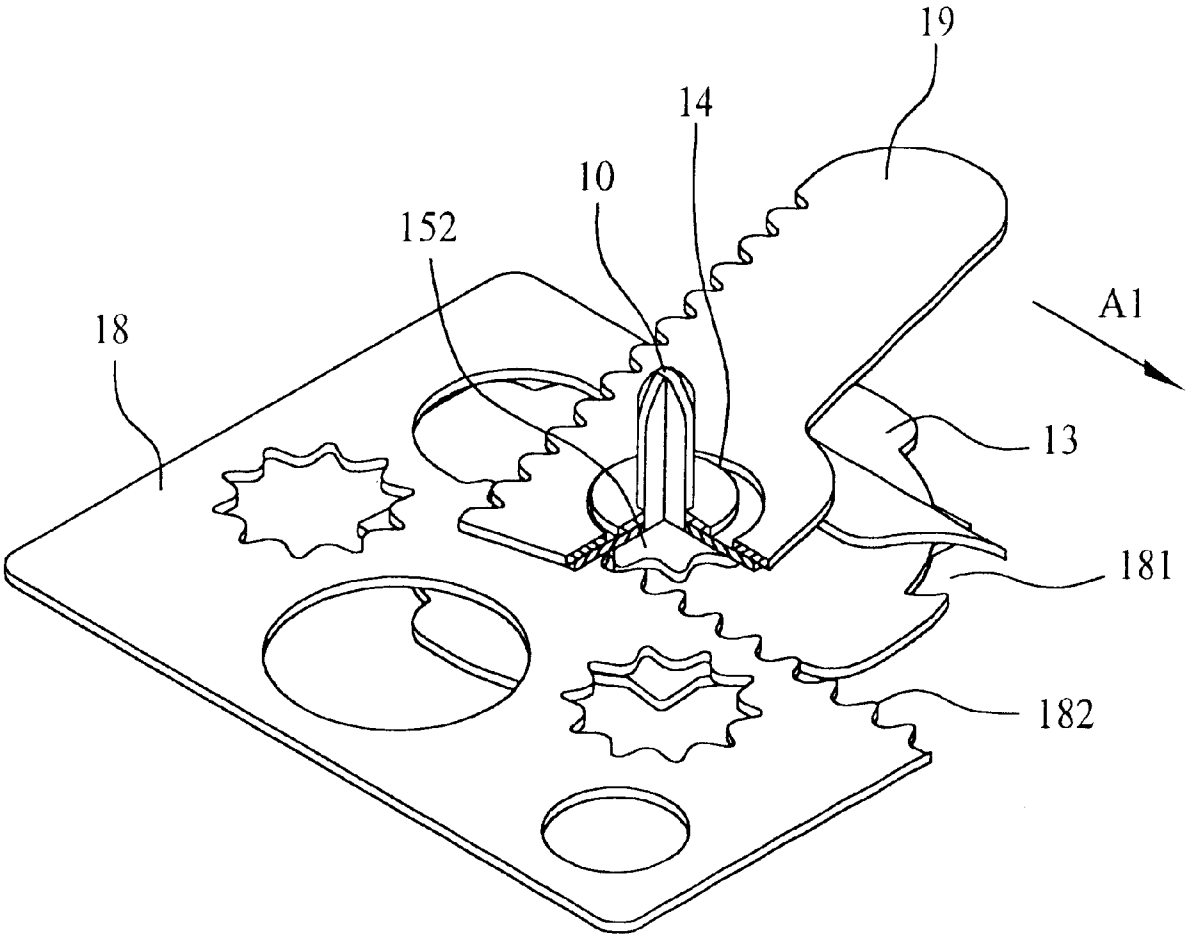
FIG. 9 shows a first manner of ejecting the spinning top of FIG. 5 with the ejecting platform and the hand-operated push member.

FIG. 9 shows a first manner of ejecting the built-up spinning top of the second embodiment with the ejecting platform 18 and the hand-operated push member 19. First, slide the spinning top into the sliding way 181 of the ejecting platform 18 with the toothed longitudinal edge 182 of the sliding way 181 engaging with the annular receiving space 17 between the upper gear member 152 and the large disc member 13. Then, position the hand-operated push member 19 over the spinning top with the round hole 191 at the front end of the push member 19 engaging with the second small disc member 14 on the top of the spinning top. Thereafter, move the push member 19 in a direction as indicated by the arrow A1. At this point, the toothed edge 182 interferes with the upper gear member 152 to cause rotation of the spinning top along the sliding way 181. When the spinning top is moved forward to finally leave the sliding way 181 of the ejecting platform 18, it is able to stand upright on a horizontal plane and spin about the pointed lower center of the central shaft 10 in a balanced state, creating an interesting and dynamic effect.

Figure 10:
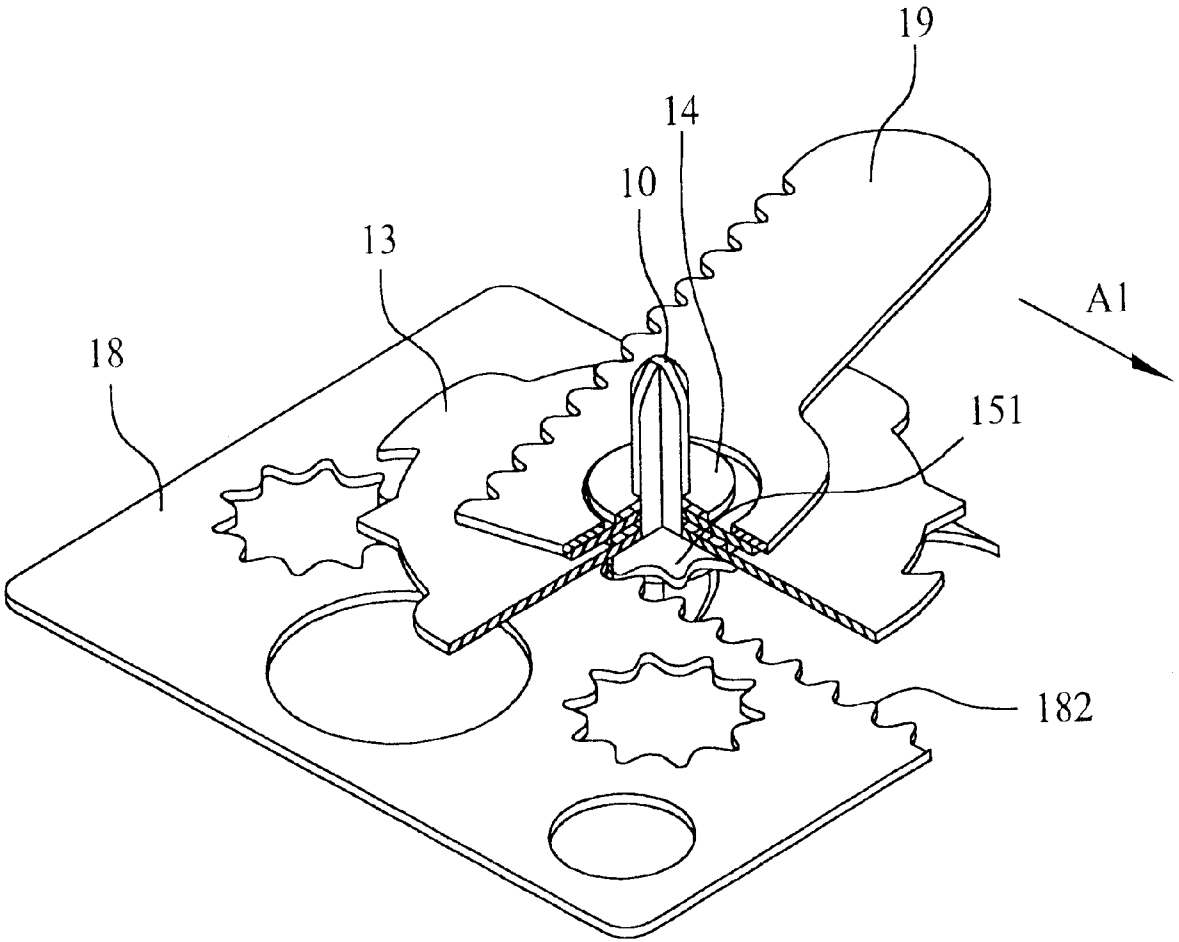
FIG. 10 shows a second manner of ejecting the spinning top of FIG. 5 with the ejecting platform and the hand-operated push member.

FIG. 10 shows a second manner of ejecting the built-up spinning top of the second embodiment with the ejecting platform 18 and the hand-operated push member 19. The second playing manner is generally similar to the first one, except that the spinning top is slidably positioned on the ejecting platform 18 with the lower gear member 151 meshing with the toothed longitudinal edge 182 of the sliding way 181.

All the flat pieces for forming the built-up spinning top of the present invention are initially detachably connected to one or more flat boards. FIG. 11 shows the large disc member 13, the first shaft member 11, the second shaft member 12, and the first small disc member 14 are included in the same one flat board S1, while the lower and the upper gear members 151, 152, the median disc member 16, the second small disc member 14, the ejecting platform 18, and the hand-operated push member 19 are included in another flat board S2. It is understood these flat pieces may also be included in just one flat board. This design enables the built-up spinning top of the present invention before assembling to be easily packed with other merchandise and used as a premium.

What is claimed is:

1. A built-up spinning top system comprising a top including:

(a) a central shaft including at least first and second axially extended shaft members, said first and second shaft members being engaged one with the other in crossed manner to collectively define for said central shaft a crossed sectional contour, said central shaft having a bottom spinning tip portion defined thereon; and, (b) a plurality of disc members coaxially disposed engaging said central shaft, said disc members including at least one large disc member and at least a first small disc member each having a cross-shaped opening receiving said central shaft therethrough;

said shaft and disc members prior to assembly of said built-up spinning top respectively forming detachably delineated parts of a substantially planar unitary structure.

2. The built-up spinning top system as recited in claim 1 wherein:

said first shaft member of said central shaft includes an elongate shaft body having a lower end portion, said lower end portion forming a pair of stoppers defining an upwardly extended first slit therebetween; and, said second shaft member of said central shaft engaging said first slit, said second shaft member including an elongate shaft body having a downwardly extended second slit formed in an upper end portion thereof for engaging said first shaft member, said shaft body having a lower end portion forming a pair of stoppers;

said stoppers of said first and second shaft member shaft bodies respectively having tapered peripheries collectively defining said bottom spinning tip portion of said central shaft.

3. The built-up spinning top system as recited in claim 1 wherein said disc members further include a second small disc member axially offset from said large disc member, a median disc member axially offset from said large disc member, an upper gear member disposed between said median and large disc members to define a substantially annular first space thereabout, and a lower gear member disposed between said large and first small disc members to define a substantially annular second space thereabout.

4. The built-up spinning top system as recited in claim 3 further comprising an ejecting platform and a push member, said ejecting platform having a sliding way at least partially defined by a toothed edge portion configured for slidably engaging one of said first and second spaces of said top, whereby said toothed edge portion is adapted to engage one of said upper and lower gear members and impart thereto a rotational force responsive to said top being displaced by said push member through said sliding way.

5. The built-up spinning top system as recited in claim 4 wherein said push member includes a front end portion having formed therein a substantially round hole configured to coaxially receive said small disc member therein.

6. The built-up spinning top system as recited in claim 4 wherein said second small disc member is disposed axially above said median disc member.

7. The built-up spinning top system as recited in claim 4 wherein said ejecting platform includes an enlarged opening communicating with said sliding way.

* * * * *